US009538854B1

(12) United States Patent
Jackson

(10) Patent No.: US 9,538,854 B1
(45) Date of Patent: Jan. 10, 2017

(54) NOTCHED MATTRESS ASSEMBLY

(71) Applicant: Stephani M. Jackson, Omaha, NE (US)

(72) Inventor: Stephani M. Jackson, Omaha, NE (US)

( * ) Notice: Subject to any disclaimer, the term of this patent is extended or adjusted under 35 U.S.C. 154(b) by 0 days.

(21) Appl. No.: 15/087,203

(22) Filed: Mar. 31, 2016

Related U.S. Application Data

(60) Provisional application No. 62/140,755, filed on Mar. 31, 2015.

(51) Int. Cl.

| | |
|---|---|
| ***A47C 27/00*** | (2006.01) |
| ***A47C 31/00*** | (2006.01) |
| ***A47G 9/02*** | (2006.01) |
| ***A47C 27/14*** | (2006.01) |

(52) U.S. Cl.
CPC ..... *A47C 27/146* (2013.01); *A47C 27/00* (2013.01); *A47G 9/0246* (2013.01); *A47C 31/00* (2013.01)

(58) Field of Classification Search
CPC ..... A47C 31/00; A47C 27/00; A47G 9/02; A47G 9/0238; A47G 9/0246
USPC ..... 5/692, 690, 498, 482
See application file for complete search history.

(56) References Cited

U.S. PATENT DOCUMENTS 1,883,837 A * 10/1932 Wallace ..... A47C 21/022 5/248
2,093,713 A * 9/1937 Dayhuff et al. ..... A47C 31/02 5/692
2,119,706 A * 6/1938 Drexler et al. .... A47C 27/0456 5/692
2,417,333 A * 3/1947 Waetzman ..... A47C 31/105 5/411
2,556,924 A * 6/1951 Karpen ..... A47C 27/053 5/692
2,643,399 A * 6/1953 Haefliger ..... A47C 27/05 5/692
2,947,008 A 8/1960 Wild
3,154,797 A * 11/1964 Lovette ..... A47C 23/00 5/296
3,252,170 A * 5/1966 Frye ..... A47C 23/0433 24/113 R
3,512,191 A * 5/1970 Wall et al. ..... A47C 27/146 297/218.2
3,728,747 A * 4/1973 Docker ..... A47C 27/00 5/692
3,887,950 A 6/1975 Wachsman
4,305,167 A 12/1981 Bargados
4,389,744 A 6/1983 Monroe
4,916,766 A * 4/1990 Grandy ..... A47C 21/022 5/496
5,150,486 A * 9/1992 Wu ..... A47C 21/022 24/559
5,313,679 A 5/1994 Yamaguchi
5,465,440 A 11/1995 Heptner
(Continued)

*Primary Examiner* — Robert G Santos
(74) *Attorney, Agent, or Firm* — Tyson B. Benson; Advent, LLP

(57) ABSTRACT

A mattress assembly is described that permits the placement of a fitted sheet without lifting the mattress assembly. The mattress assembly includes a mattress substrate configured to rest on a surface or bed frame (i.e. box spring), and one or more notches configured to form recesses that accommodate a human hand and retain a fitted sheet. In some embodiments, the notches are located at the corners of the mattress substrate. In other embodiments, the notches can be continuous, forming a groove around the perimeter of the mattress substrate.

20 Claims, 9 Drawing Sheets

(56) References Cited

U.S. PATENT DOCUMENTS

| | | | | |
|---|---|---|---|---|
| 5,555,578 | A * | 9/1996 | Wyatt | A47C 21/022 24/72.5 |
| 5,758,372 | A | 6/1998 | Lopez Diaz | |
| 7,596,822 | B2 | 10/2009 | Sakaldasis | |
| 8,522,376 | B2 * | 9/2013 | Rohr | A47C 31/00 5/411 |
| 2007/0283494 | A1 | 12/2007 | Vasey | |
| 2008/0040856 | A1 | 2/2008 | Adamson | |
| 2009/0229053 | A1 | 9/2009 | Amsler, Jr. | |
| 2011/0302715 | A1 | 12/2011 | Battaglia | |
| 2012/0124741 | A1 | 5/2012 | Okrzesik | |
| 2013/0185868 | A1 * | 7/2013 | Rohr | A47C 31/00 5/498 |
| 2013/0232698 | A1 | 9/2013 | Ward | |
| 2015/0026885 | A1 | 1/2015 | Christensen | |

* cited by examiner

NOTCHED MATTRESS ASSEMBLY

CROSS-REFERENCE TO RELATED APPLICATIONS

The present application claims the benefit under 35 U.S.C. §119(e) of U.S. Provisional Application Ser. No. 62/140,755, filed Mar. 31, 2015, and titled "NOTCHED MATTRESS ASSEMBLY". U.S. Provisional Application Ser. No. 62/140,755 is herein incorporated by reference in its entirety.

BACKGROUND

A mattress is a large pad for supporting the reclining body, used as or on a bed. A conventional mattress consists of a core layer and a support layer. Mattresses are typically placed on a bed base, such as a box spring. Mattress can be formed from a variety of materials (e.g. coils, foam, etc.). Mattresses can be covered with fitted bed sheets that have a material such as elastic or drawstring around the base to hold the sheet against the mattress.

SUMMARY

A mattress assembly is described that permits the placement of a fitted sheet without lifting the mattress assembly. The mattress assembly includes a mattress substrate configured to rest on a surface or bed frame (i.e. box spring), and one or more notches configured to form recesses that accommodate a human hand and retain a fitted sheet. In some embodiments, the notches are located at the corners of the mattress substrate. In other embodiments, the notches can be continuous, forming a groove around the perimeter of the mattress substrate.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The Detailed Description is described with reference to the accompanying figures. The use of the same reference numbers in different instances in the description and the figures may indicate similar or identical items.

DETAILED DESCRIPTION

Overview

Figure 1A:
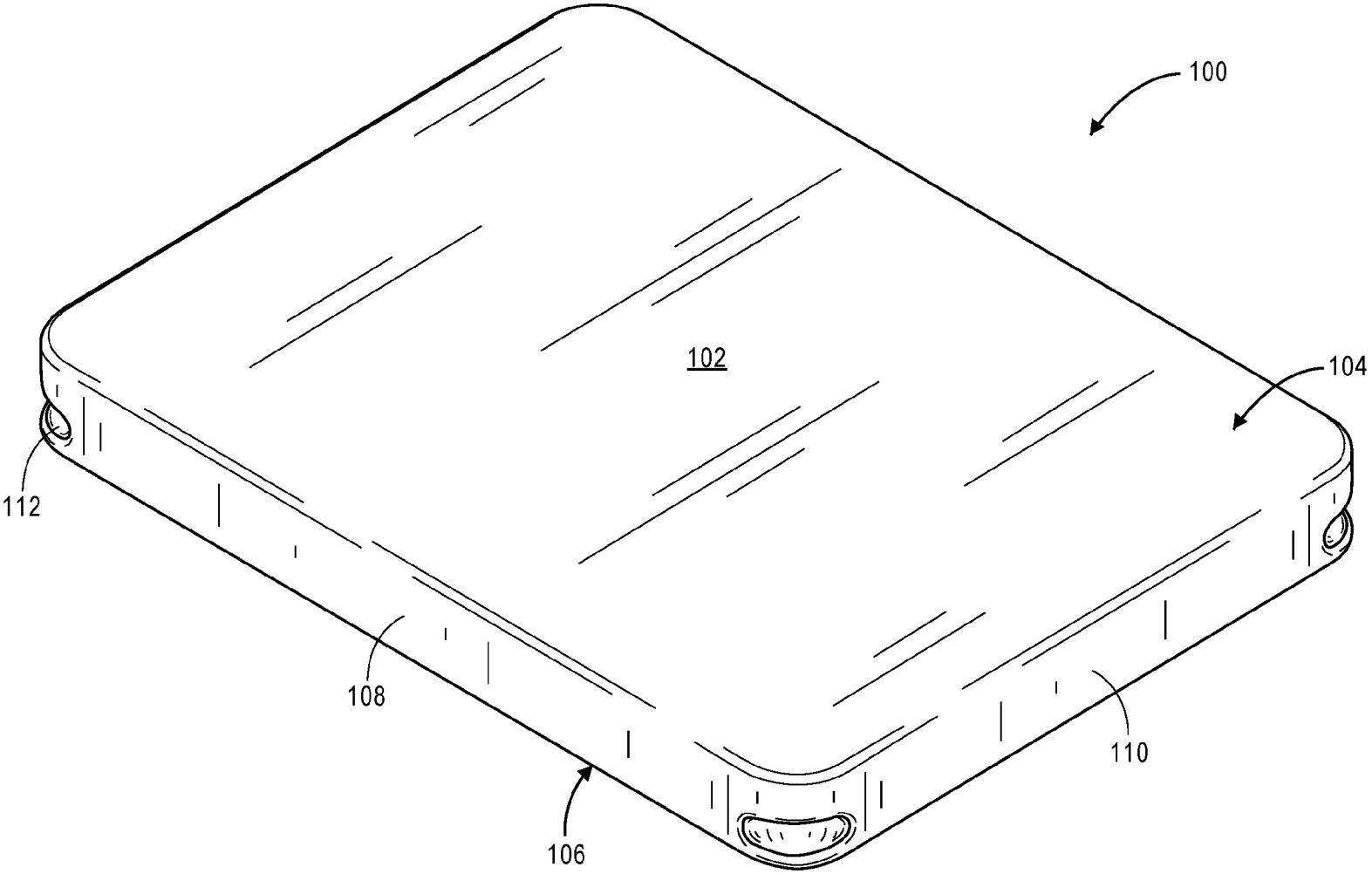
FIG. 1A is an isometric view illustrating a mattress assembly with notches located at the corners, in accordance with an example embodiment of the present disclosure.

Conventional mattresses are typically constructed as a solid rectangular piece and are configured to rest flatly on a surface or bed frame. Placing a fitted sheet on a conventional mattress requires lifting the mattress off of the floor or bed frame, while simultaneously attempting to position a large sheet. Lifting the mattress can be difficult for smaller individuals or those with physical handicaps. Placing the fitted mattress can also be difficult on certain bed frames where the bottom side rails extend above the base of the mattress or when the mattress is positioned against a wall or similar obstruction that limits access to a portion of the mattress.

A mattress assembly is described that permits the placement of a fitted sheet without lifting the mattress assembly. The mattress assembly includes a mattress substrate configured to rest on a surface or bed frame (i.e. box spring), and one or more notches configured to form recesses that accommodate a human hand and retain a fitted sheet. In some embodiments, the notches are located at the corners of the mattress substrate. In other embodiments, the notches can be continuous, forming a groove around the perimeter of the mattress substrate. The mattress assembly can further include a decorative band configured to cover the space formed between the edge of the fitted sheet and the second surface of the mattress assembly.

Example Implementations

Referring generally to FIGS. 1 through 7, a mattress assembly 100 is described. The mattress assembly 100 includes a mattress substrate 102 comprising a first surface 104 and a second surface 106. In embodiments, the mattress substrate 102 can be comprised of a variety of materials including, but not limited to: metal coils, foam, gel foam, polyurethane, latex, and so forth; or any combination thereof.

Referring generally to FIGS. 1A through 2B, the first surface 104 and second surface 106 of the mattress substrate 102 are connected by sides 108 and ends 110. The second surface 106 is configured to rest on a surface or bed frame (e.g., box spring). The first surface 104 and/or the second surface 106 includes one or more notches 112. The notches 112 are configured to form recesses extending into the sides 108 and ends 110 of the mattress substrate 102. The notches 112 are comprised to accommodate a human hand and provide a way to grip the mattress assembly 100. The notches 112 are comprised to allow a fitted sheet 114 to conform to the mattress substrate 102. In implementations, the notches 112 permit the placement of a fitted sheet 114 without lifting the mattress substrate 102. The notches 112 also permit removal of the fitted sheet 114 without lifting the mattress substrate 102.

Figure 1B:
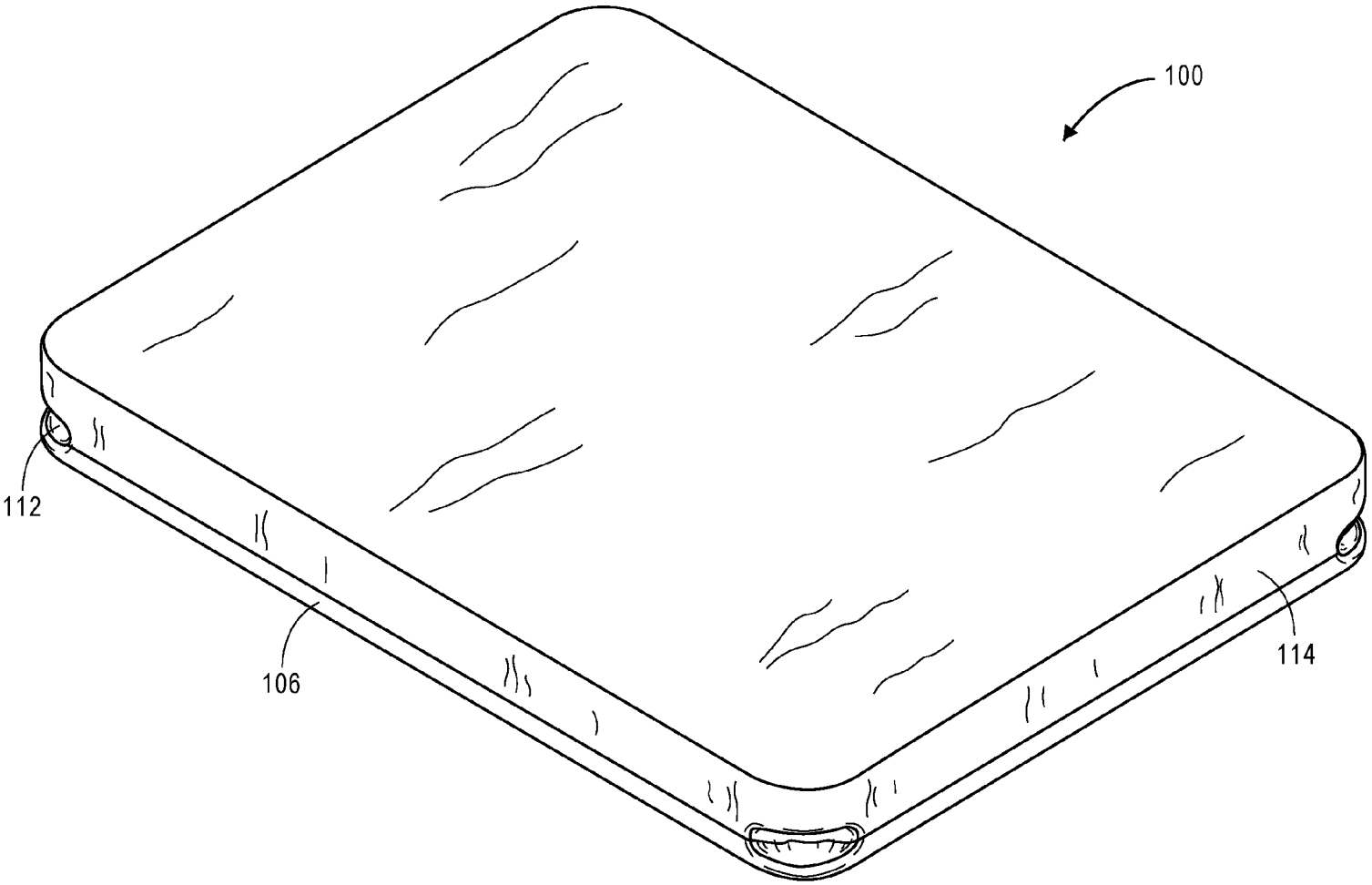
FIG. 1B is an isometric view illustrating a mattress assembly with notches located at the corners, further including a fitted sheet, in accordance with an example embodiment of the present disclosure.

FIGS. 1A and 1B illustrate that in some embodiments, the mattress assembly 100 can include one or more individual notches 112 located at the corners of the mattress substrate 102. In some embodiments, the notches 112 can be located near the second surface 106. The notches 112 extend from the corners of the second surface 106 into the planes of the sides 108 and the ends 110, forming recesses in the corners on or near the second surface 106 of the mattress substrate 102. In one example of this embodiment, the mattress substrate 102 can comprise a conventional queen size mattress with notches 112 that are approximately 2.5 inches in height, approximately 5 inches in width, and located approximately 1 inch from the second surface 106 of the mattress substrate 102. In some embodiments, the substrate 102 can include additional notches 112 located at the corners of the first surface 104. These embodiments can be utilized on double-sided (i.e., flippable) mattresses, permitting the fitted sheet 114 to fit on either side of the mattress substrate 102.

Figure 2A:
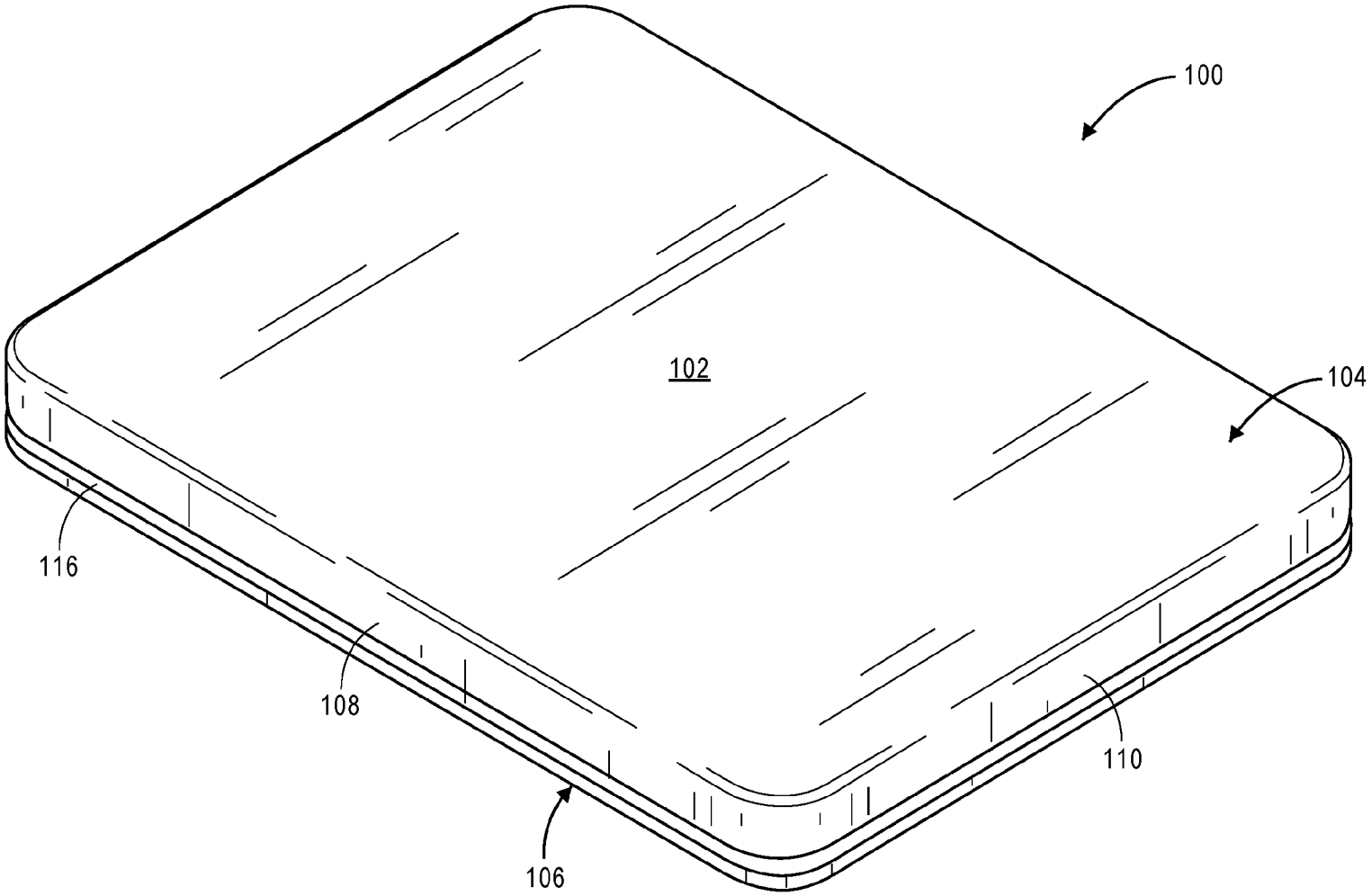
FIG. 2A is an isometric view illustrating a mattress assembly with a continuous notch located around the perimeter of the mattress assembly, in accordance with an example embodiment of the present disclosure.
Figure 2B:
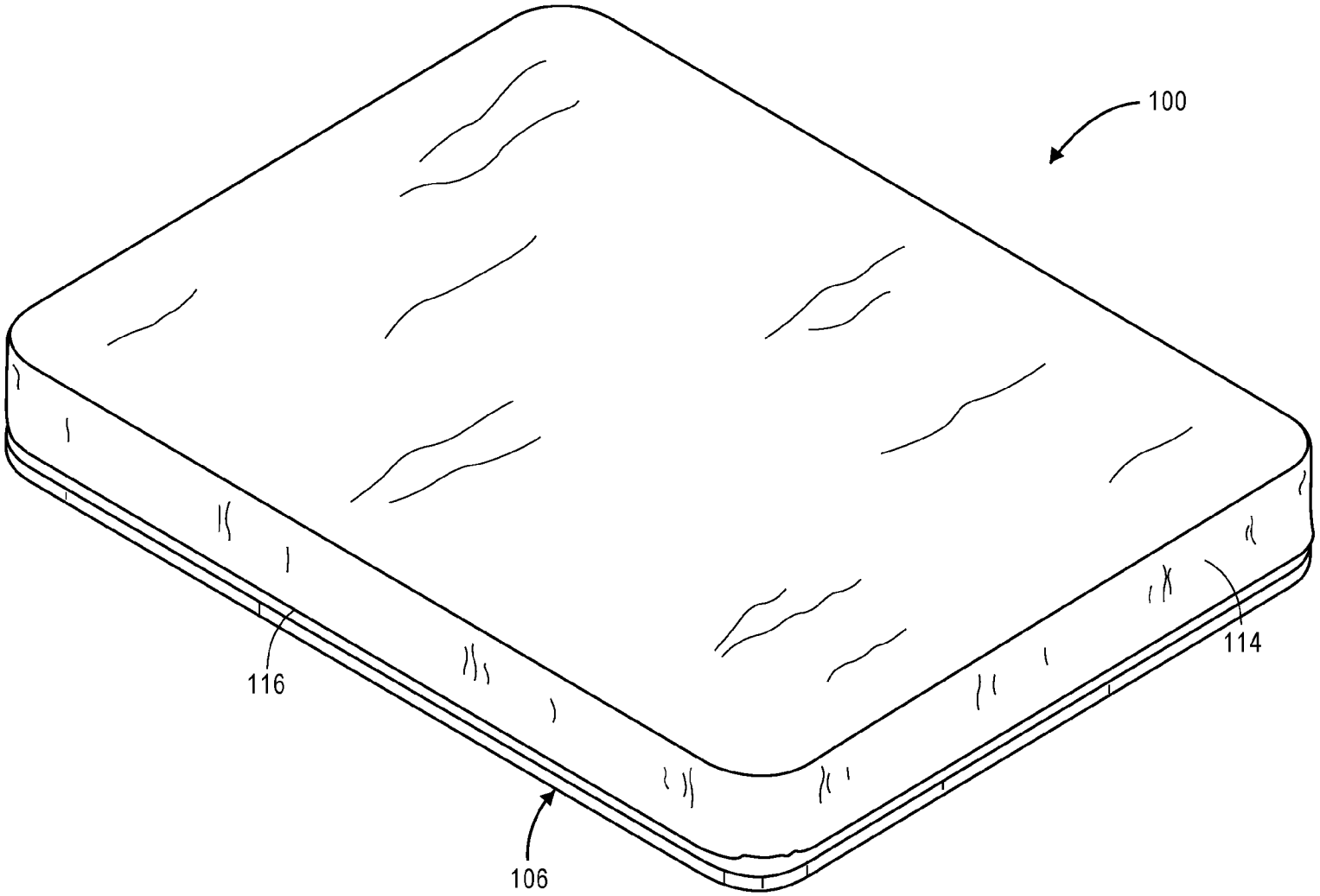
FIG. 2B is an isometric view illustrating a mattress assembly with a continuous notch located around the perimeter of the mattress assembly, further including a fitted sheet, in accordance with an example embodiment of the present disclosure.

FIGS. 2A and 2B illustrate that in embodiments, the notches 112 can comprise a continuous notch 116 located near the second surface 106. The continuous notch can extend around the entire perimeter of the mattress substrate 102, forming a recess extending into both the sides 108 and the ends 110. The continuous notch 116 thus forms a lip or groove around the perimeter of the substrate 102. The continuous notch 116 can both provide a way to grip the mattress substrate 102, and securely retain the fitted sheet 114 around the perimeter of the mattress substrate 102.

Figure 3A:
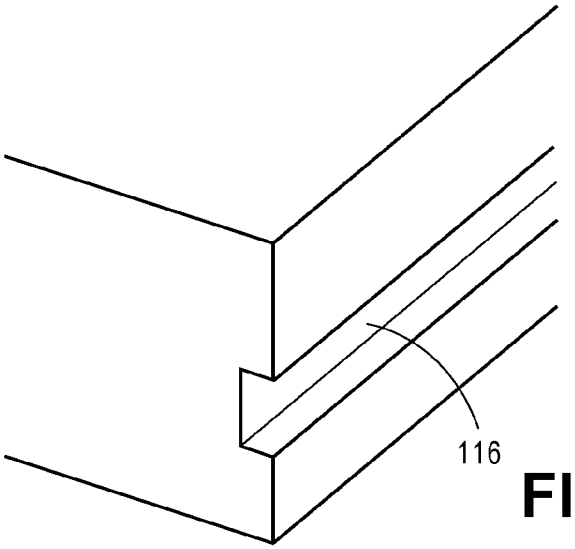
FIGS. 3A through 3D are isometric views illustrating configurations of a continuous notch, in accordance with an example embodiment of the present disclosure.
Figure 3B:
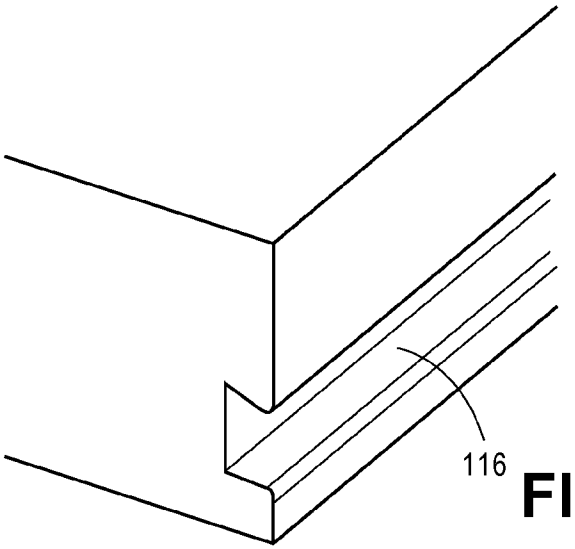
Figure 3C:
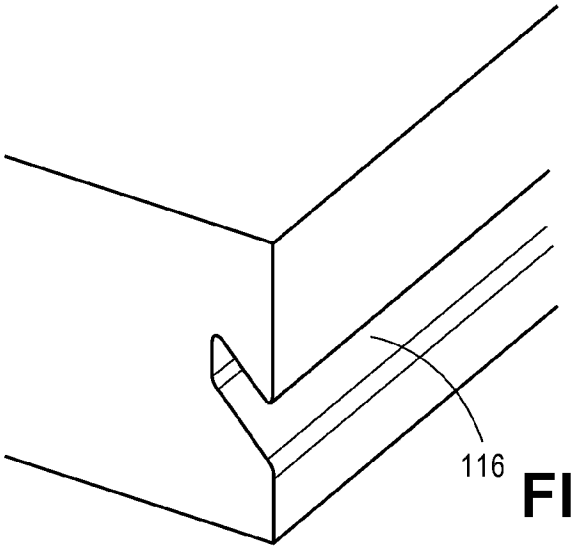
Figure 3D:
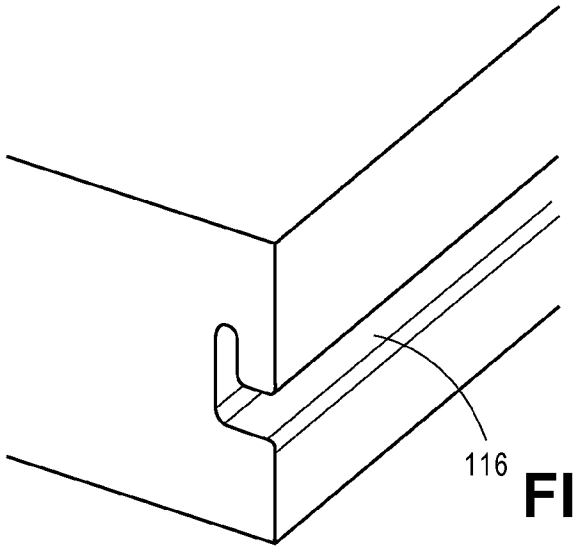

In embodiments, the continuous notch 116 can comprise a variety of shapes and angles, as illustrated in FIGS. 3A through 3D. In some embodiments, the continuous notch 116 can be rectangular in shape with approximately 90 degree angles, as illustrated in FIG. 3A. In other embodiments, the top and/or the bottom portion of the continuous notch 116 can be angled, with an angle selected so as to retain a fitted sheet 114 and/or accommodate the fingers of a hand, as illustrated in FIG. 3B. For example, the angle of the continuous notch 116 can be between about 40 degrees and about 70 degrees. In some embodiments, both the top and bottom portions of the continuous notch 116 are angled, as illustrated in FIG. 3C. This embodiment can minimize the accumulation of debris (e.g., dust, dirt, hair, etc.) within the continuous notch 116. In other embodiments, the continuous notch 116 can comprise an "L" shape, as illustrated in FIG. 3D. However, these configurations continuous notches 116 are offered by way of example only and are not meant to be restrictive of the present disclosure. In other embodiments, the continuous notch can comprise other shapes and angles.

In embodiments, the height of the continuous notch 116 can also be selected to accommodate fingers. In an example embodiment, the height of the continuous notch 116 is at least 1.5 inches. The depth of the continuous notch 116 can be significant in relation to the ability to accommodate human fingers and/or the ability to retain the fitted sheet 114. In example embodiments, the depth of the continuous notch 116 is between about 0.75 inches and about 2.0 inches.

The distance between the bottom surface 106 and the continuous notch 116 can be selected based on the type of surface (e.g., box spring) that the mattress assembly 100 will rest on, so that the fitted sheet 114 can cover nearly the entirety of the mattress substrate 102. In some embodiments, the mattress substrate 102 can be configured to rest on top of the box spring, with the continuous notch 116 located just above the bottom surface 106. In other embodiments, the mattress substrate 102 can be configured to rest upon a bed frame with bed rails that extend above the bottom surface 106. In these embodiments, the distance between the bottom surface 106 and the continuous notch 116 can be greater. Positioning the continuous notch 116 in locations that accommodate various bed frames and box springs allows for the mattress substrate 102 to be used on a variety of bed types without requiring any lifting of the mattress assembly 100.

Figure 4:
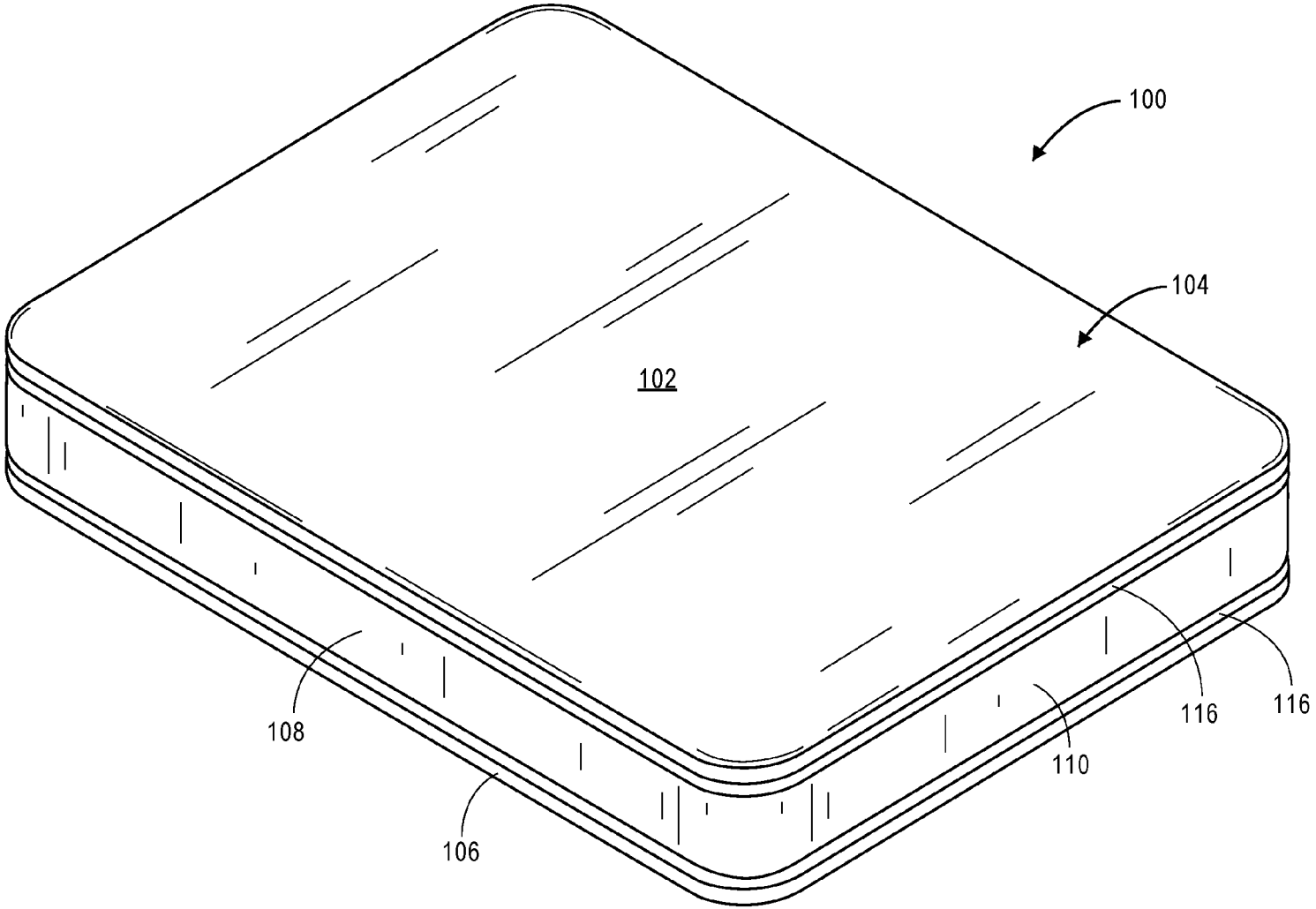
FIG. 4 is an isometric view illustrating a mattress assembly with a continuous notch located around the perimeter of the mattress assembly, further including a second continuous notch, in accordance with an example embodiment of the present disclosure.

In some embodiments, the mattress assembly 100 can include one or more additional continuous notches 116. For example, the mattress substrate 102 can include a second continuous notch 116 located near the first surface 104 and extending around the perimeter of the substrate 102, as illustrated in FIG. 4. These embodiments can be utilized on double-sided (i.e., flippable) mattresses, permitting the fitted sheet 114 to fit on either side of the mattress substrate 102.

It is to be understood that these configurations of notches 112 are offered by way of example only and are not meant to be restrictive of the present disclosure. In embodiments, the mattress assembly 100 can include one or more additional notches 112, continuous notches 116, or any combination thereof.

Figure 5:
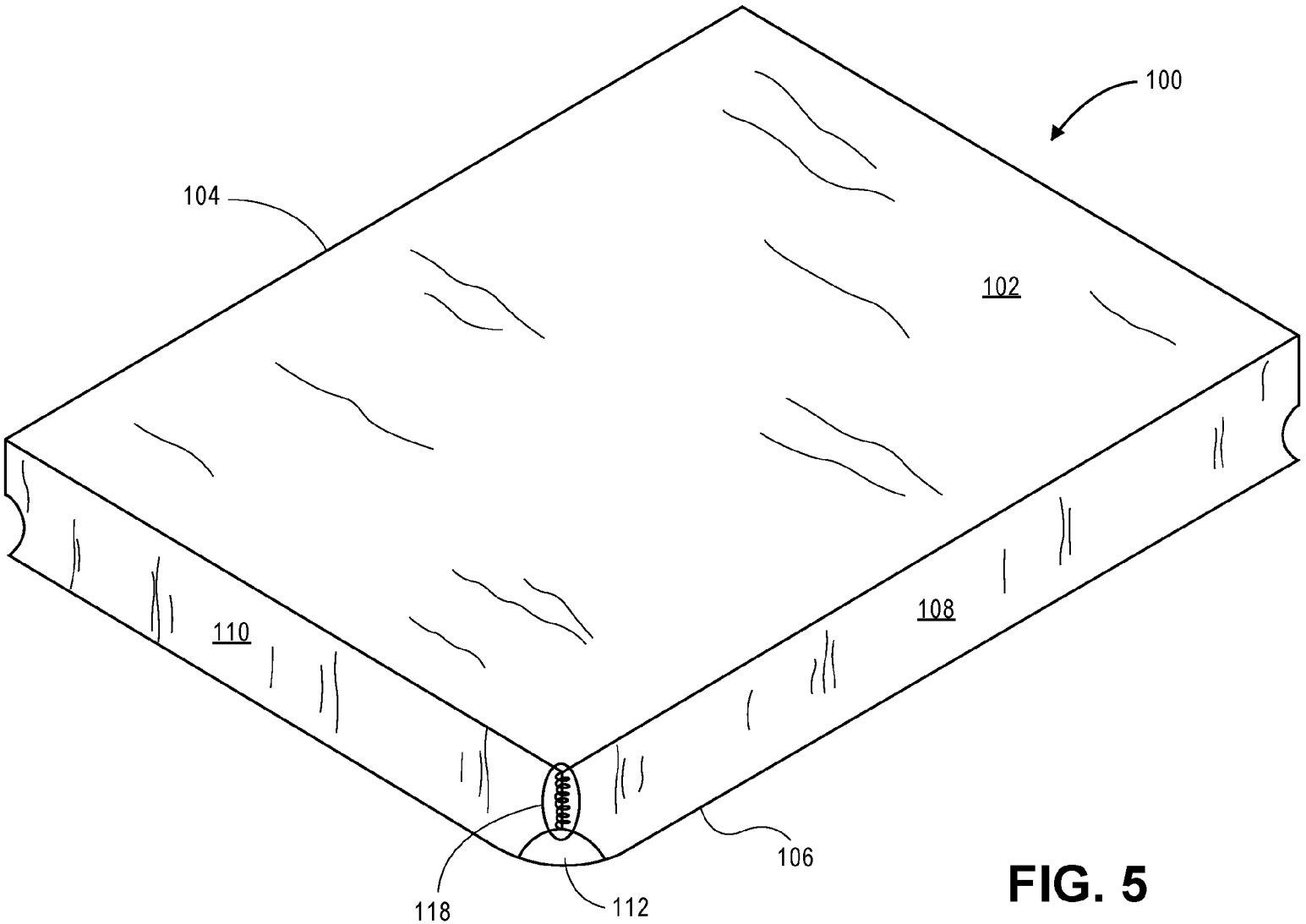
FIG. 5 is an isometric view illustrating a mattress assembly formed with shortened coils, in accordance with an example embodiment of the present disclosure.

FIG. 5 illustrates a formation of individual notches 112 in a conventional coil mattress substrate. The notches 112 can be formed by placing shortened coils 118 in the areas of the mattress corresponding to the notches 112. In embodiments the shortened coils 118 can be ¾ the length of traditional mattress coils. It should be noted that the length of the shortened coils 118 is provided by way of example only and is not meant to limit the present disclosure. In other embodiments, alternative coil lengths (e.g., ⅔ the length of traditional mattress coils) can be used. Yet, in other embodiments, the notches 112 can have a depth that is selected to accommodate traditional coils. For example, the notches 112 can be shallowly cut with less extension into the sides 108 and ends 110 to accommodate traditional coils.

Figure 6A:
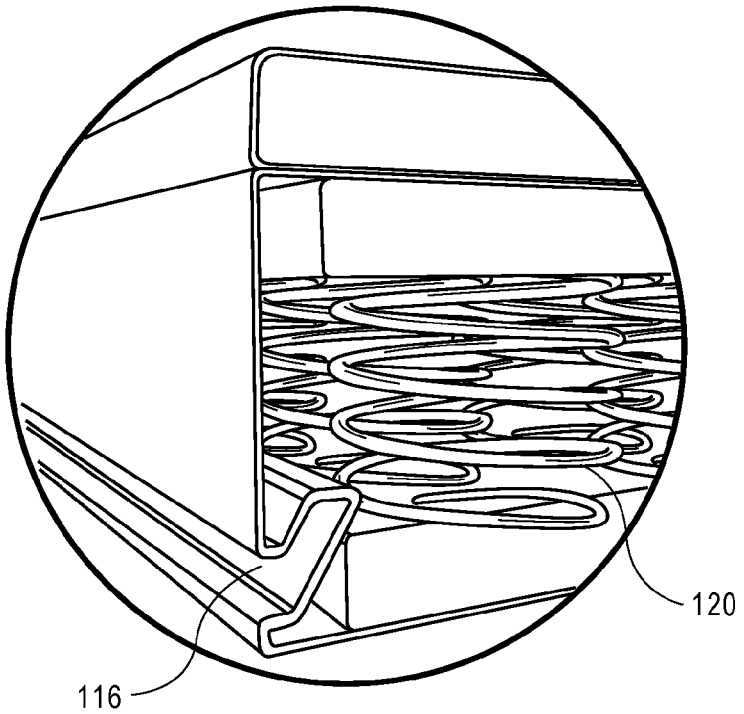
FIGS. 6A and 6B are isometric views illustrating a continuous notch formed in a mattress assembly including coil springs, in accordance with an example embodiment of the present disclosure.
Figure 6B:
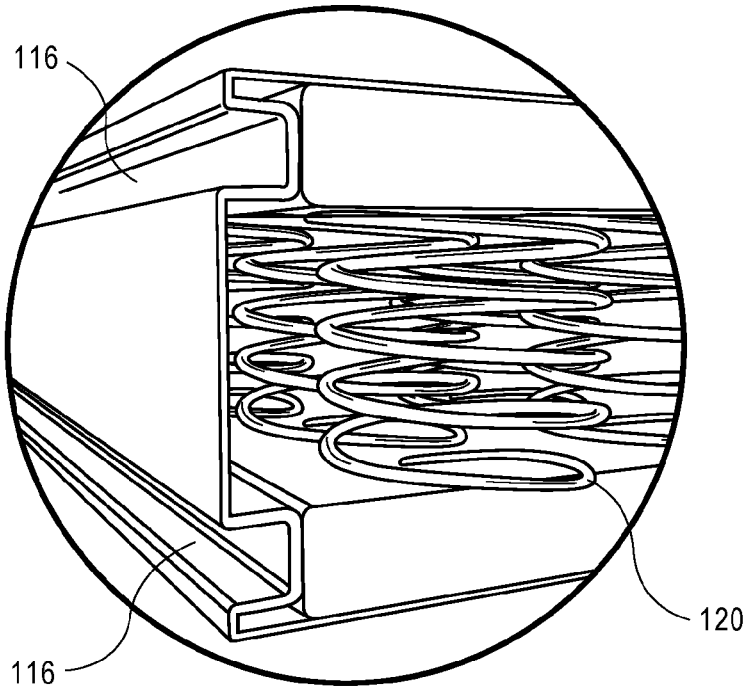

FIGS. 6A and 6B illustrate the formation of a continuous notch 116 in a conventional coil mattress substrate 102. The continuous notch 116 extends shallowly into the sides 108 and ends of the mattress substrate 102, and can accommodate traditional coils 120. Both an angled continuous notch 116, as illustrated in FIG. 6A, and a rectangular continuous notch, as illustrated in FIG. 6B, can have a depth and/or a width and/or length that is selected to accommodate traditional coils 120. For example, the continuous notch 116 can be shallowly cut to accommodate traditional coils 120. If a deeper continuous notch 116 is desired, shortened coils 118 may be utilized, as described above. In these embodiments, the mattress assembly 100 comprises a notched portion and an un-notched portion. For instance, the mattress assembly 100 comprises a notched portion that comprises the structural portion of the mattress assembly 100 including the notched portion (e.g., the structural portion pertaining to the mattress assembly having the depth and/or width and/or length for the notch portion), and the mattress assembly 100 comprises an un-notched portion that comprises the structural portion of the mattress assembly 100 including the un-notched portion.

However, these formations of the notches 112 and continuous notches 116 are offered by way of example only and are not meant to be restrictive of the present disclosure. In other embodiments, the notches 112 and/or continuous notches 116 can be formed as a cutout in the solid portion (e.g., foam, gel foam, etc.) of the mattress substrate 102. In some other embodiments, the notches 112 and/or continuous notches 116 can be formed in a frame that can be sewn into the mattress assembly 100 during the manufacturing process. It also contemplated that the notches 112 and/or continuous notches 116 can be formed as a part of the bed frame and or box spring (e.g., notches located at the corners of the box spring; lip formed on the box spring, etc.).

Figure 7:
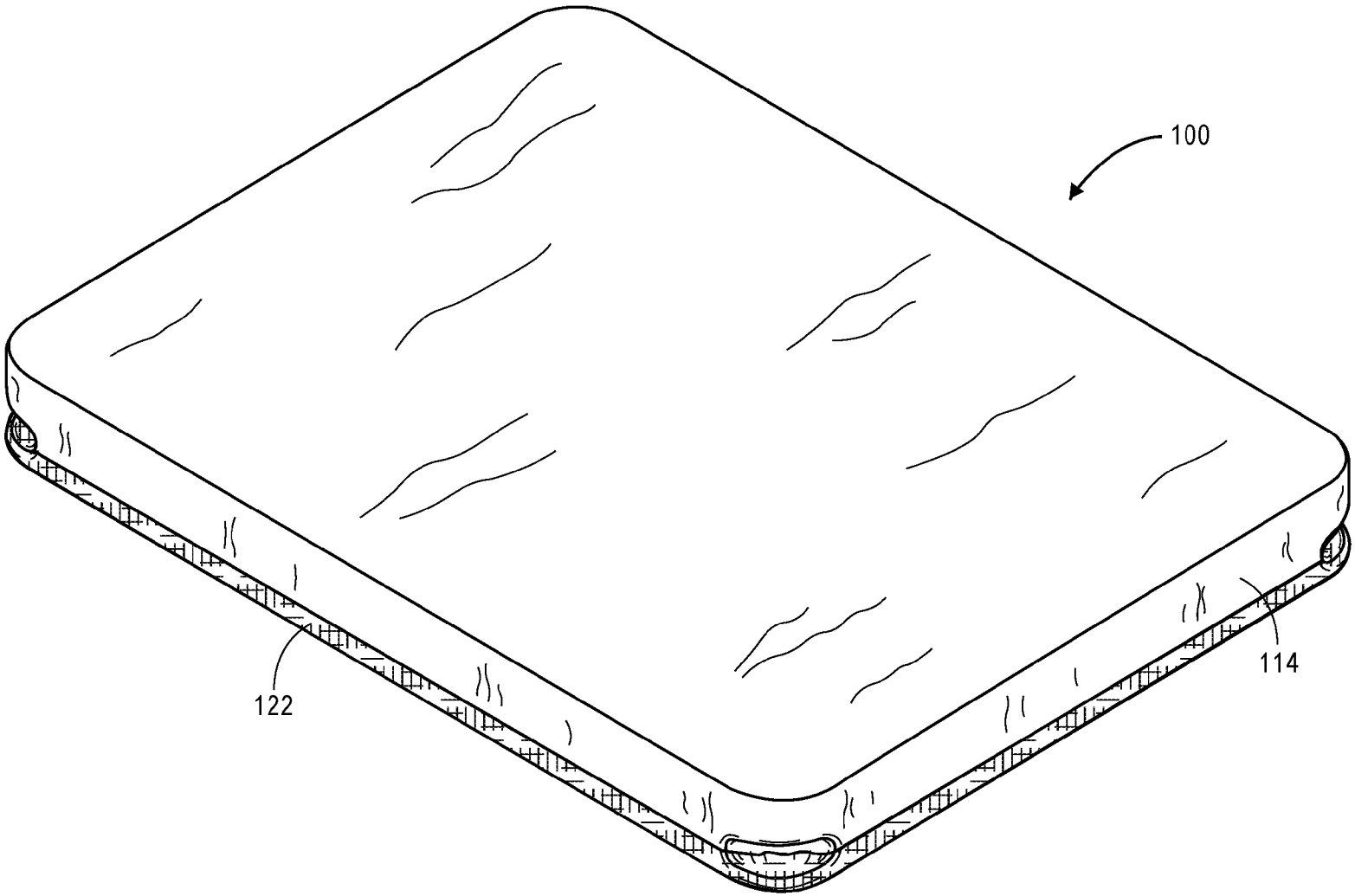
FIG. 7 is an isometric view illustrating a mattress assembly with a fitted sheet and decorative band, in accordance with an example embodiment of the present disclosure.

FIG. 7 illustrates that the mattress assembly 100 can further include a decorative band 122. The decorative band 122 is configured to extend around the perimeter of the mattress substrate 102, covering the space formed between the edge of the fitted sheet 114 and the second surface 106 of the mattress substrate 102. It should be noted that forming the decorative band 122 from fabric is provided by way of example only and is not meant to limit the present disclosure. In other embodiments, the decorative band can be formed by other means or from other materials (e.g., formed as a part of the mattress itself during the manufacturing process).

In implementations, a conventional fitted sheet 114 may be utilized with the mattress assembly 100. In other implementations, the fitted sheet 114 may comprise a sheet of a shortened length to better conform to notches 112 and/or continuous notches 116.

Conclusion

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A mattress assembly comprising:

a mattress substrate comprising a contiguous layer, the contiguous layer including a first surface and a second surface, the first surface and the second surface connected by sides and ends;

a continuous notch defined by the mattress substrate, the continuous notch disposed between the first surface and the second surface, the notch extending into the sides and ends, and forming a groove around the perimeter of the mattress substrate, the continuous notch comprising at least one angled portion with an angle of between about 40 degrees and about 70 degrees and a height of at least 1.5 inches in order to accommodate the fingers of a human hand; and a decorative band, the decorative band configured to cover the space formed between the groove and at least one of the first surface or the second surface of the mattress.

2. The mattress assembly as recited in claim 1, wherein the continuous notch is configured to have a depth selected to accommodate traditional mattress coils.

3. The mattress assembly as recited in claim 1, wherein the continuous notch is configured to retain a fitted sheet disposed on the mattress substrate.

4. The mattress assembly as recited in claim 3, wherein the decorative band is configured to cover the space formed between the edge of the fitted sheet and the second surface of the mattress substrate.

5. The mattress assembly as recited in claim 1, wherein the depth of the continuous notch is between about 0.75 inches and 2.0 inches.

6. The mattress assembly as recited in claim 1, further comprising two angled portions, wherein the angled portions are configured to prevent debris from accumulating within the continuous notch.

7. A mattress comprising:

a mattress substrate comprising a contiguous layer, the contiguous layer including a first surface and a second surface, the first surface and the second surface connected by sides and ends;

one or more notches defined by the mattress substrate, the one or more notches configured to extend into the planes of the sides and ends with a height of at least 1.5 inches in order to accommodate the fingers of a human hand and forming fixed recesses disposed between the first surface and the second surface.

8. The mattress as recited in claim 7, wherein the one or more notches are disposed at the corners of the mattress substrate.

9. The mattress as recited in claim 7, wherein the one or more notches is configured as a continuous notch forming a groove around the perimeter of the mattress substrate.

10. The mattress as recited in claim 9, wherein the continuous notch is configured to retain a fitted sheet disposed on the mattress substrate.

11. The mattress as recited in claim 10, further comprising a decorative band, the decorative band configured to cover the space formed between the edge of fitted sheet and the second surface of the mattress substrate.

12. The mattress as recited in claim 7, wherein the one or more notches are configured to have a depth selected to accommodate traditional mattress coils.

13. A mattress comprising:

a mattress substrate comprising a contiguous layer, the contiguous layer including a first surface and a second surface, the first surface and the second surface connected by sides and ends;

a continuous notch defined by the mattress substrate, the continuous notch disposed between the first surface and the second surface, the notch extending into the sides and ends with a height of at least 1.5 inches in order to accommodate the fingers of a human hand and forming a groove around the perimeter of the mattress substrate.

14. The mattress as recited in claim 13, wherein the continuous notch is configured to have a depth selected to accommodate traditional mattress coils.

15. The mattress as recited in claim 13, wherein the depth of the continuous notch is between about 0.75 inches and 2.0 inches.

16. The mattress as recited in claim 13, wherein the continuous notch is configured to retain a fitted sheet disposed on the mattress substrate.

17. The mattress as recited in claim 13, further comprising two angled portions configured to prevent debris from accumulating within the continuous notch, wherein each angled portion has an angle of between about 40 degrees and about 70 degrees.

18. The mattress as recited in claim 13, wherein the continuous notch comprises a rectangular notch.

19. The mattress as recited in claim 13, wherein the continuous notch comprises an angled notch including one or more angled portions.

20. The mattress as recited in claim 19, wherein the angle is between about 40 degrees and about 70 degrees.

* * * * *